US006112669A

United States Patent [19]

Mravic et al.

[11] Patent Number: 6,112,669

[45] Date of Patent: Sep. 5, 2000

[54] PROJECTILES MADE FROM TUNGSTEN AND IRON

[75] Inventors: Brian Mravic, North Haven; Peter W. Robinson, Branford, both of Conn.

[73] Assignee: Olin Corporation, Norwalk, Conn.

[21] Appl. No.: 09/092,301

[22] Filed: Jun. 5, 1998

[51] Int. Cl.[7] ..... C22C 1/02; C22C 33/04

[52] U.S. Cl. ..... 102/501; 420/122; 148/337

[58] Field of Search ..... 102/501; 420/122; 148/337

[56] References Cited

U.S. PATENT DOCUMENTS

| | | | |
|---|---|---|---|
| H1235 | 10/1993 | Canaday | 102/334 |
| 4,005,660 | 2/1977 | Pichard | 102/92.1 |
| 4,027,594 | 6/1977 | Olin et al. | 102/92.4 |
| 4,428,295 | 1/1984 | Urs | 102/448 |
| 4,850,278 | 7/1989 | Dinkha et al. | 102/501 |
| 4,881,465 | 11/1989 | Hooper et al. | 102/501 |
| 4,939,996 | 7/1990 | Dinkha et al. | 102/501 |
| 4,949,644 | 8/1990 | Brown | 102/498 |
| 4,949,645 | 8/1990 | Hayward et al. | 102/517 |
| 5,088,415 | 2/1992 | Huffman et al. | 102/515 |
| 5,264,022 | 11/1993 | Haygarth et al. | 75/255 |
| 5,399,187 | 3/1995 | Mravic et al. | 75/228 |
| 5,527,376 | 6/1996 | Amick et al. | 75/246 |
| 5,713,981 | 2/1998 | Amick | 75/340 |
| 5,760,331 | 6/1998 | Lowden et al. | 102/506 |

FOREIGN PATENT DOCUMENTS 2 149 067 9/1988 United Kingdom .

OTHER PUBLICATIONS

Federal Cartridge Company, "Application for U.S. Fish and Wildlife Service Review and Approval of Tungsten–Iron Shot as Nontoxic Shot", Aug. 19, 1996.

*Primary Examiner*—Daniel J. Jenkins
*Attorney, Agent, or Firm*—William A. Simons; Wiggin & Dana

[57] ABSTRACT

A lead-free projectile made from a composition containing about 5–25% by weight tungsten and more than about 97% by weight tungsten plus iron.

20 Claims, No Drawings

PROJECTILES MADE FROM TUNGSTEN AND IRON

BACKGROUND OF THE INVENTION

1. Field of the Invention

This invention relates to projectiles such as bullets and shotgun shot made from a composition containing a specific mixture of tungsten and iron.

2. Brief Description of the Art

Ingestion of expended lead shot by birds, particularly water fowl, has been said to pose a problem in the wild. In indoor shooting ranges, vaporized lead-containing primer powder and vapors from lead bullets is also of concern. Disposal of lead-contaminated soil and sand from shooting ranges is expensive, since lead is a hazardous material. Accordingly, various attempts have been made to find alternatives or substitutes for lead bullets and lead shot.

U.S. Pat. No. 4,428,295 (with Urs as the named inventor and assigned to Olin Corporation) is drawn to high density shot formed by the compaction of two different metallic powders, a first one of the powders having a density greater than lead and the second one being formable under compaction to serve as a binder. In a preferred embodiment, the first powder is tungsten and the second powder is lead.

U.S. Pat. No. 4,949,645 (assigned to Royal Ordnance) discloses shot formed by compacting and sintering a mixture of tungsten, nickel and copper powders.

Statutory Invention Registration H1235 (with Canaday as the named inventor) discloses a tungsten base armor-piercing projectile containing a tungsten carbide alloy.

The use of tungsten-iron mixtures in projectiles is also known. For example, U.S. Pat. No. 5,264,022 (with Haygarth as the named inventor) is directed to high specific gravity, non-toxic, lead-free shotshell pellets consisting of an alloy of iron and tungsten, wherein the content of tungsten is 30% to 46% by weight. This Haygarth patent discloses that tungsten and iron are heated to a temperature above 1,637° C. forming a molten metal mixture. The molten metal is passed through a refractory sieve having holes of a desired diameter to generate molten droplets. These droplets flow through a shot column having first a gas portion to solidify the droplets as spheres and, second, a liquid portion to cool the droplets.

Federal Cartridge Company also made an application to the U.S. Fish and Wildlife Service for the review and approval of sintered tungsten-iron shot as a non-toxic shot dated Aug. 19, 1996. According to this application, the shot proposed by Federal is a sintered powder metallurgical product containing tungsten and iron with a typical tungsten range of 38% to 42% by weight, with the balance of the mixture being iron. The proposed manufacturing process for this shot has the steps of: (1) combining tungsten and iron; (2) sintering at a temperature of 1,520° C.; and (3) bringing the sintered powder metallurgy product to thermal equilibrium. The Federal Application identifies a two-phase material, which is formed with the first phase being a solid solution of tungsten and ferritic iron and the second phase being an intermetallic compound $Fe_7W_6$. The Federal Application further states that the shot can be picked up with a magnet.

U.S. Pat. No. 5,339,187 (with Mravic et al. as the named inventors and assigned to Olin Corporation) is directed to frangible lead-free bullets having a density similar to that of lead comprising a compacted composite containing a high-density first constituent selected from the group consisting of tungsten, tungsten carbide, ferro-tungsten and mixtures thereof; and a lower density second constituent selected from the group consisting of tin, zinc, aluminum, iron, copper, bismuth and mixtures thereof, wherein the density of said lead-free bullet is in excess of 9 grams per cubic centimeter and said lead-free bullet deforms or disintegrates at a stress of less than about 45,000 psi.

Separately, Sykes (W. P. Sykes, Trans. AIME, Vol. 73, 1926) teaches that when a molten alloy of tungsten and iron having less than 29.3% by weight tungsten is rapidly cooled from the solid solution temperature region just below the solidus down to room temperature, there will be insufficient time for a precipitation of a second-phase iron tungsten intermetallic particles, and the resulting cooled material will be a solid solution of these two metals. In contrast, Sykes found that slow cooling down to room temperature or a short heat treatment after rapid cooling will cause the formation of these intermetallic particles.

It has now been found that tungsten-iron compositions having a relatively low tungsten content and a relatively high tungsten plus iron content can provide suitable properties (e.g., hardness, ductility, and density) for use as different types of projectiles. That discovery has lead to the following invention.

BRIEF SUMMARY OF THE INVENTION

Accordingly, one aspect of the present invention is directed to a lead-free projectile, comprising:

a composition comprising tungsten and iron;

wherein the tungsten content in the composition is from about 5% to about 25% by weight;

wherein the iron plus tungsten content of the composition is at least about 97% by weight, said percentages based on total weight of the composition.

Another aspect of the present invention is directed to a lead-free projectile such as shot comprising:

a composition comprising tungsten and iron;

wherein the tungsten content in the composition is from about 5% to about 25% by weight;

wherein the iron plus tungsten content of the composition is at least about 97% by weight, said percentages based on the total weight of the composition; and wherein said composition is lead-free and shaped like a projectile (e.g., shot) and has a density of about 70–95% of lead and is a solid solution of tungsten and ferritic iron and is substantially free of a second phase of intermetallic iron-tungsten particles.

Still another aspect of the present invention is directed to a lead-free bullet comprising:

a composition comprising tungsten and iron;

wherein the tungsten content in the composition is from about 5% to about 25% by weight;

wherein the iron plus tungsten content of the composition is at least about 97% by weight, said percentages based on the total weight of the composition;

wherein said composition is lead-free and shaped like a bullet and has a Brinell hardness of about 100 to about 400.

One preferred embodiment of the present invention is directed to a lead-free projectile shot or bullet having the above-noted compositions and additionally containing up to about 1% by weight, each based on the total weight of the composition, of silicon, manganese and aluminum, or mixtures thereof.

DETAILED DESCRIPTION OF THE PREFERRED EMBODIMENTS OF THE PRESENT INVENTION

The expression "lead-free projectile" as used in the present specification and claims refers to any and all types of projectiles, including bullets and shotgun shot that contain no more than a trace amount (i.e., less than about 100 ppm), more preferably no amount, of lead.

The expression "solid solution of tungsten and ferritic iron" as used in the present specification refers to any solid mixtures or alloys of tungsten and ferritic iron in a single solid phase.

The expression "a density of about 70–95% of lead" as used in the present specification and claims refers to densities of the present tungsten/iron compositions as compared to the density of lead at the same conditions (e.g., same temperature and pressure).

The expression "substantially free of a second phase of the intermetallic iron-tungsten particles" as used in the present specification and claims refers to compositions of iron and tungsten where the amount of this second phase is less than about 1% by weight of the total composition; preferably, less than about 0.5% by weight; more preferably, less than about 0.1% by weight of the composition. Most preferably, for these embodiments, the composition is completely free of this second phase.

The tungsten/iron compositions of the present invention could be made from relatively inexpensive raw materials, including iron or low carbon steel scrap and ferrotungsten. The latter is a low cost ferroalloy typically used in making tool steels.

The tungsten/iron compositions of the present invention can be made by many processes depending upon the type of projectile desired. For example, shotgun shot or shotgun pellets could be made in several ways.

One way to make shot is to pass the melted liquid mixture of tungsten and iron through porous ceramic screens or filters to form liquid streams and drops which then become spherical due to surface tension forces while they fall through air or an inert gaseous atmosphere into a water quench tank. This method is analogous to the way lead shot has been routinely made.

A second way to make shot would be to pour the molten alloy into an atomizer in which the molten metal is broken up into spherical, or nearly spherical, droplets by the atomizing fluid. The fluid may be liquid, such as water or gaseous, such as air or, preferably, an inert gas such as nitrogen. In the case of gaseous atomization, it is preferred to quench the droplets in water quickly after they have been formed in the high-speed gas stream.

Shot could also be formed with tungsten/iron compositions of the present invention by conventional die casting or by conventional powder metallurgical processes.

Also, shot could be formed by extrusion of cast billets into rods, drawing those rods into wire, chopping the wire to a desired length, and then forming shot from the cut wire, as is done with steel shot.

In each case for making shotgun shot with the preferred compositions of the present invention, it is necessary to have a rapid cooling to room temperature to form the solid solution of tungsten and iron without the undesirable hard, abrasive intermetallic iron-tungsten particles being formed in the shot. Thus, the shot of the present invention, with the absence of such abrasive particles therein, will advantageously both minimize wear on shot processing equipment and reduce the chances of damage to shotgun barrels.

In any case, the thus-formed shot pellets of the present invention may be processed further to improve their roundness, smoothness and the other desired properties using techniques similar to those used for steel shot or steel abrasive blasting pellets.

Likewise, bullets using the composition of the present invention may be formed by several conventional techniques. One way would be to cast a tungsten/iron rod of the desired diameter. The rod would be quenched in water or cooled by other means on exiting the mold to prevent precipitation of the undesired hard second phase articles. This cast rod could then be cut into the appropriate length, and then forged, swaged, pressed or machined to the desired final shape.

An alternative way to make bullets of the present invention is to cast billets that are then extruded into a rod of the desired diameter.

Also, conventional die casting techniques to make net shape or near net shape bullets may be used. And further, powder metallurgical techniques could be used. When making bullets, the absence of the hard, intermetallic iron-tungsten second phase particles in the composition is not critical as with shotgun shot because such bullets may be jacketed.

If powder metallurgical techniques are used, it is expected that the bullets may have some precipitation hardening during sintering or during cooling after the sintering operation. If desired, bullets could be subsequently heat treated to soften them by heating them to the solid solution temperature range appropriate for the specific tungsten/iron composition employed, and either quenching to prevent precipitation of more second phase particles, or slow cooling to allow the precipitation of very coarse second phase particles which are too large to provide significant hardening to the resulting bullet. Of course, quenching is preferable from the standpoint of preventing damage to bullet processing equipment because of the excess hardness of some bullets.

Generally, it is preferred to harden non-frangible penetrating bullets by aging the above-noted tungsten/iron composition which is substantially free of a second phase of hard intermetallic iron-tungsten particles and which has been made in the general desired bullet shape. For example, aging at 700° C. for two hours would provide maximum hardness and strength for penetrating bullets containing about 20–25% by weight tungsten. In this case, the bullets would achieve Brinell hardnesses of about 325 to about 390. Bullets containing 5–15% tungsten can be aged for times up to 20 hours at 700° C.; however, their maximum Brinell hardnesses would be only about 120–220. Accordingly, it is generally preferred to use compositions containing about 20–25% by weight tungsten for making penetrating bullets.

For some projectile applications, it may be preferred to additionally employ small amounts (i.e., up to 1% by weight each) of silicon, manganese and aluminum, or mixtures of two or all three of these elements. These additional elements may be added for the purpose of melt deoxidization and to adjust the surface tension to an optimum value for further processing as described above. The composition may also contain low levels of impurities typical of carbon and alloy steels such as sulfur and phosphorus.

While the invention has been described above with reference to specific embodiments thereof, it is apparent that many changes, modifications and variations can be made without departing from the inventive concept disclosed herein. Accordingly, the present invention is intended to embrace all such changes, modifications and variations that fall within the spirit and broad scope of the appended claims. All patent applications, patents and other publications cited herein are incorporated herein by reference in their entirety.

What is claimed is:

1. A lead-free projectile comprising:

(1) a composition of tungsten and iron;

(2) wherein the tungsten content in the composition is from about 5% to about 25% by weight;

(3) wherein the iron plus tungsten content of the composition is at least about 97% by weight, said percentages based on the total weight of the composition; and (4) wherein said composition is lead-free and is shaped like a projectile and is made from a solid solution of tungsten and ferritic iron that is substantially free of a second phase of hard intermetallic iron-tungsten particles.

2. The projectile of claim 1 wherein said projectile is a bullet.

3. The projectile of claim 2 wherein the bullet is a penetrating bullet and the tungsten content is from about 20% to about 25% by weight.

4. The projectile of claim 2 wherein said composition has a Brinell hardness of about 100 to about 400.

5. The projectile of claim 4 wherein said composition has a tungsten content of about 20–25% by weight and a Brinell hardness of about 325 to 400.

6. The projectile of claim 1 wherein the projectile has a density of about 70–95% of lead.

7. The projectile of claim 1 wherein said composition additionally contains no more than about 1% by weight, each based on the total weight of the composition, of silicon, manganese, and aluminum or mixtures thereof.

8. A lead-free projectile comprising:

(a) a composition of tungsten and iron;

(b) wherein the tungsten content in the composition is from about 5% to about 25% by weight;

(c) wherein the iron plus tungsten content of the composition is at least about 97% by weight, said percentages based on the total weight of the composition; and (d) wherein said composition is lead-free and is shaped like a projectile and is made from a solid solution of tungsten and ferritic iron that is substantially free of a second phase of hard intermetallic iron-tungsten particles, and (e) wherein the projectile is made by the steps of:

(1) forming a liquid mixture of tungsten and iron;

(2) cooling that liquid mixture into a solid composition of tungsten and iron;

(3) subjecting said solid composition to at least one cycle of a heat treatment followed by rapid cooling to form a solid solution of tungsten and ferritic iron that is substantially free of a second phase of hard intermetallic iron-tungsten particles; and (4) forming a projectile shape with that solid solution.

9. The projectile of claim 8 wherein said composition has a Brinell hardness of about 100 to about 400.

10. The projectile of claim 8 wherein said composition has a tungsten content of about 20–25% by weight and a Brinell hardness of about 325 to 400.

11. The projectile of claim 8 wherein the projectile has a density of about 70–95% of lead.

12. The projectile of claim 8 wherein the projectile is a bullet.

13. The projectile of claim 12 wherein the bullet is a penetrating bullet and the tungsten content is from about 20% to about 25% by weight.

14. The projectile of claim 8 wherein said composition additionally contains no more than about 1% by weight, each based on the total weight of the composition of silicon, manganese and aluminum or mixtures thereof.

15. The projectile of claim 8 wherein the projectile is a shot.

16. The projectile of claim 12 wherein the projectile is a shot.

17. The process for making a lead-free projectile wherein said projectile comprises:

(a) a composition of tungsten and iron;

(b) wherein the tungsten content in the composition is from about 5% to about 25% by weight;

(c) wherein the iron plus tungsten content of the composition is at least about 97% by weight, said percentages based on the total weight of the composition; and (d) wherein said composition is lead-free and is shaped like a projectile and is made from a solid solution of tungsten and ferritic iron that is substantially free of a second phase of hard intermetallic iron-tungsten particles, and said process comprises the steps of:

(1) forming a liquid mixture of tungsten and iron;

(2) cooling that liquid mixture into a solid composition of tungsten and iron;

(3) subjecting said solid composition to at least one cycle of a heat treatment followed by rapid cooling to forma solid solution of tungsten and ferritic iron that is substantially free of a second phase of hard intermetallic iron-tungsten particles; and (4) forming a projectile shape with that solid solution.

18. The process of claim 17 wherein the projectile shape formed is for a shot.

19. The process of claim 17 wherein the projectile shape formed is for a bullet.

20. The process of claim 19 wherein the bullet is a penetrating bullet and the tungsten content is from about 20% to about 25% by weight.

* * * * *